US007596885B2

(12) United States Patent
Adrian et al.

(10) Patent No.: US 7,596,885 B2
(45) Date of Patent: Oct. 6, 2009

(54) MICROWAVE DRYING OF CERAMIC STRUCTURES

(75) Inventors: Paul Andreas Adrian, Weselberg (DE); James Anthony Feldman, Campbell, NY (US); Jacob George, Horseheads, NY (US); Elizabeth Marie Vileno, Corning, NY (US)

(73) Assignee: Corning Incorporated, Corning, NY (US)

( * ) Notice: Subject to any disclaimer, the term of this patent is extended or adjusted under 35 U.S.C. 154(b) by 496 days.

(21) Appl. No.: 11/495,203

(22) Filed: Jul. 28, 2006

(65) Prior Publication Data

US 2008/0023886 A1 Jan. 31, 2008

(51) Int. Cl.
*F26B 3/28* (2006.01)
*H05B 6/64* (2006.01)

(52) U.S. Cl. ..... 34/259; 264/432

(58) Field of Classification Search ..... 264/431, 264/432; 34/259

See application file for complete search history.

(56) References Cited

U.S. PATENT DOCUMENTS

| | | | | |
|---|---|---|---|---|
| 3,854,021 | A | 12/1974 | Moore | 219/729 |
| 3,935,415 | A | 1/1976 | Moore | 219/750 |
| 5,388,345 | A | 2/1995 | Brundage et al. | 34/256 |
| 6,259,078 | B1 | 7/2001 | Araya | |
| 6,706,233 | B2 | 3/2004 | Araya | |
| 6,717,120 | B2 | 4/2004 | Fritts | 219/700 |
| 6,764,743 | B2 | 7/2004 | Kato | |
| 6,773,481 | B2 | 8/2004 | Noguchi | |
| 6,797,666 | B2 | 9/2004 | Harada | |
| 6,803,086 | B2 | 10/2004 | Noguchi | |
| 6,808,663 | B2 | 10/2004 | Noguchi | |
| 6,818,580 | B2 | 11/2004 | Kumazawa | |
| 6,833,537 | B2 | 12/2004 | Risman | 219/690 |
| 6,878,337 | B2 | 4/2005 | Noguchi | |
| 7,017,278 | B2 | 3/2006 | Kato | |
| 2002/0139795 | A1 * | 10/2002 | Araya et al. | 219/680 |
| 2005/0093209 | A1 * | 5/2005 | Bergman et al. | 264/474 |
| 2005/0115101 | A1 * | 6/2005 | Nate et al. | 34/442 |
| 2006/0042116 | A1 * | 3/2006 | Terazawa et al. | 34/259 |

FOREIGN PATENT DOCUMENTS

| | | |
|---|---|---|
| EP | 1 491 307 | 12/2004 |
| WO | 02/054829 | 7/2002 |

* cited by examiner

*Primary Examiner*—Philip C Tucker
*Assistant Examiner*—Robert J Grun
(74) *Attorney, Agent, or Firm*—Joseph M. Homa

(57) ABSTRACT

A method for drying a ceramic article comprises providing microwave radiation from a microwave generating source, providing a ceramic honeycomb structure having a middle portion and at least one end, and exposing the ceramic honeycomb structure to the microwave radiation while shielding the at least one end from directly receiving the microwave radiation, such that the radiation absorbed by the middle portion is equal to or greater than the radiation absorbed by the at least one end, and the proper drying of the entire honeycomb structure without heat-induced structural degradation is thus ensured.

20 Claims, 6 Drawing Sheets

MICROWAVE DRYING OF CERAMIC STRUCTURES

BACKGROUND OF THE INVENTION

The present invention relates to a method for drying ceramic articles via a microwave dryer, and in particular to methods for drying ceramic honeycomb structures via a microwave dryer that promotes uniform drying of the honeycomb structures, thereby relieving or eliminating heat-induced structural degradation of the structures.

Ceramic honeycomb structures having transverse cross-sectional cellular densities of approximately one-tenth to 100 or more cells or channels per square centimeter of honeycomb cross-section have several uses, including use as particulate filter bodies, catalyst substrates, and stationary heat exchangers. Filter applications generally require that selected cells of the structure be sealed or plugged at one or both of the respective ends thereof in a manner such that wall-flow filtration, i.e., the filtering of fluids traversing the structure by directing at least some of those fluids through porous channel walls thereof, is effected.

Ceramic honeycomb manufacture involves several known steps. In general, the honeycomb shapes are first formed, e.g., by extrusion, from water-containing plasticized mixtures of ceramic raw materials. The formed honeycombs are next dried to solidify the desired honeycomb structure, and are finally fired to sinter or reaction-sinter the ceramic raw materials into strong unitary ceramic articles.

Referring to the appended drawings, the reference numeral 8 (FIG. 1) generally designates a ceramic article of a type that is well known for applications such as catalyst substrates and diesel exhaust particulate filters. The base structure in both cases is a ceramic honeycomb 10 comprising a matrix of intersecting, thin, porous cell walls 14 surrounded by an outer wall 15. In the illustrated example structure 10 is provided in a circular cross-sectional configuration including a first end 13, a second end 16 and a middle portion 17. The walls 14 extend across and between a first end face 18 and an opposing second end face 20, and form a large number of adjoining hollow passages or channels 22 which extend between and are open at the end faces 18, 20 of the structure 10.

To form a filter from structure 10 (FIGS. 2 and 3), one end of each of the cells 22 is sealed, a first subset 24 of the cells 22 being sealed at the first end face 18, and a second subset 26 of the cells 22 being sealed at the second end face 20 of the substrate 10. Either of the end faces 18, 20 may be used as the inlet face of the resulting filter. The structure 10 with seals is then fired to form the filter.

In operation, contaminated fluid is brought under pressure to an inlet face and enters the filter via those cells which have an open end at the inlet face. Because the cells are sealed at the opposite ends, i.e., the outlet face of the body, the contaminated fluid is forced through the thin porous walls 14 into adjoining cells which are sealed at the inlet face and open at the outlet face. The solid particulate contaminant in the fluid, which is too large to pass through the pore structure of the walls, is left behind and the cleansed fluid exits the filter through the outlet cells and is ready for use.

Some previous methods used for drying ceramic honeycomb structures have led to decreased structural strength due to heat-induced structural degradation. Structural strength requirements are particularly demanding for ceramic catalyst substrates and filters to be used in the mechanically harsh environment of motor vehicle exhaust emissions control systems. Nevertheless, for the mass production of such filters and substrates it is highly desirable to be able to dry the ceramic substrates rapidly and as inexpensively as possible, while maintaining structural integrity and strength.

Various drying techniques have been utilized for ceramic honeycomb manufacture in the past, including conduction heating, convection heating, and RF heating. Microwave heating has been used to achieve higher volumetric heating uniformity than conduction and/or convection heating can provide alone, while at the same time offering low operating costs and reduced processing times. However, some ceramic materials useful for constructing ceramic substrates and filters, particularly including batches for the manufacture of cordierite, mullite, aluminum titanate, and similar ceramics that include a graphite additive to increase honeycomb porosity, are more difficult to dry via microwave drying. Also problematic from a drying standpoint are honeycombs directly incorporating materials such as transition metal oxide catalysts, where the catalysts include constituents that are semiconductive or very lossy at the desired microwave drying frequency.

These drying difficulties are attributed to the inability of microwave radiation to properly penetrate into and effect uniform heating within the interior portions of such materials, due to reduced microwave permeability occasioned by the presence of graphite or other lossy materials within the ceramic batch mixtures. The consequence is that the drying of such honeycombs using microwave radiation can lead to unacceptable localized heating, which in turn leads to unstable processing, poor select rates, and lower quality ware. For example, the drying of an aluminum titanate substrate with a 30% graphite additive has produced unwanted edge heating that results in cracks and/or contour problems in the associated filter.

One possible solution to this drying problem is simply to remove damaged edge portions from the dried honeycomb parts. This solution is obviously inefficient and creates a significant amount of waste. Other solutions include changing the composition of the ceramic batch mixtures to reduce the amount of graphite or other lossy materials therein, or using multiple drying steps, or using a combination of drying methods, for example, microwave plus hot air drying, to achieve drying without structural damage. However, each of these alternatives requires accepting unwanted compromises, such as lower quality end products and/or increases in manufacturing costs.

A method for drying ceramic substrates that reduces unwanted nonuniform drying characteristics within the ceramic substrates, thereby reducing unwanted heat-induced stress cracking and structural degradation of the substrates, while simultaneously decreasing associated cycle times, and associated operating costs, is therefore desired.

SUMMARY OF THE INVENTION

The present invention relates to a method for drying a thin-walled ceramic structure such as a honeycomb comprising providing microwave radiation from a microwave generating source, providing a ceramic honeycomb structure having a middle portion and at least one end, and exposing the ceramic honeycomb structure to the microwave radiation. The method further includes shielding at least one end of the ceramic honeycomb structure from directly receiving the microwave radiation, such that the radiation absorbed by the middle portion is equal to or greater than the radiation absorbed by the at least one end. Uniform drying of the ceramic substrate with reduced heat-induced structural degradation is thereby promoted. The radiation absorbed by the middle portion is preferably within the range of from about 0% to about 60% greater than the radiation absorbed by the at least one end, and more preferably within the range of from about 10% to about 40% greater than the radiation absorbed by the at least one end.

The present method is highly accurate and repeatable, may be completed in a relatively short cycle time, is relatively easy to perform, and results in a filter with relatively greater structural integrity with reduced deformation and degradation. The method further reduces the relative cracking and stress fractures within the desired structure produced during the drying process, reduces manufacturing costs associated with cycle times, is efficient to use, and is particularly well-adapted for the proposed use.

These and other advantages of the present invention will be further understood and appreciated by those skilled in the art by reference to the following written specification, claims, and appended drawings.

DETAILED DESCRIPTION

Figure 1:
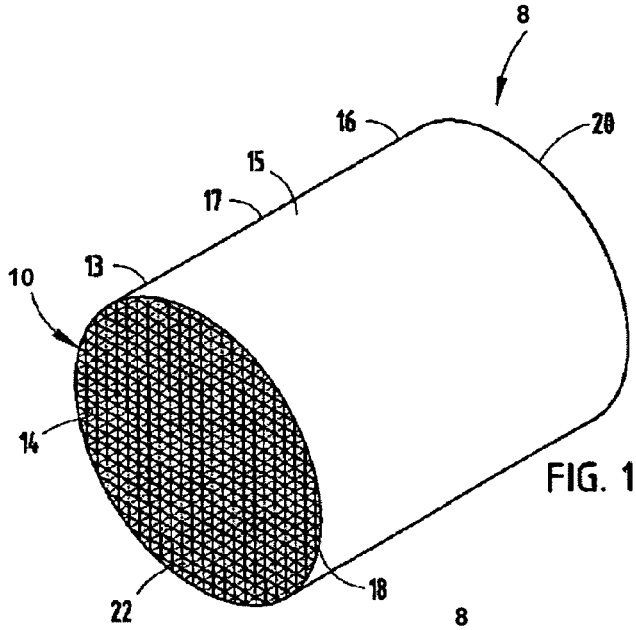
FIG. 1 is a perspective view of a ceramic honeycomb structure the drying of which embodies the present invention.
Figure 2:
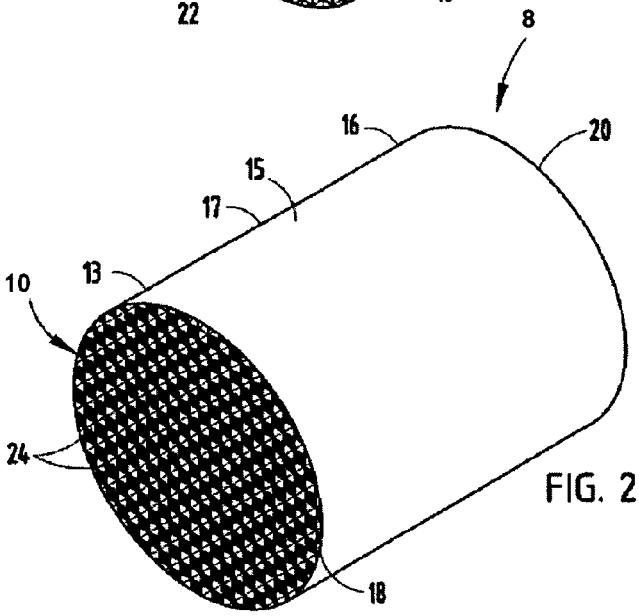
FIG. 2 is a perspective view of the ceramic honeycomb structure with alternatively plugged channels.
Figure 3:
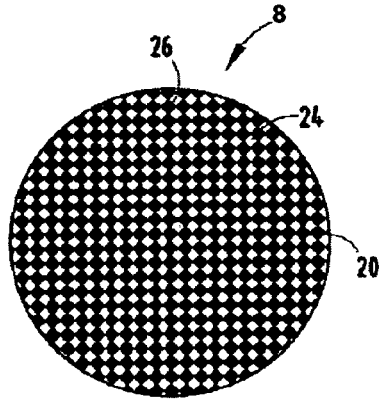
FIG. 3 is an end elevational view of the ceramic honeycomb structure of FIG. 2.
Figure 4:
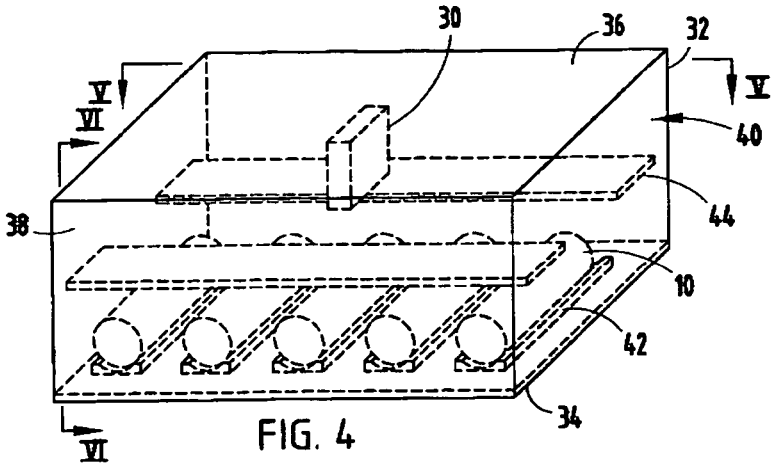
FIG. 4 is a top perspective view of a microwave dryer with a plurality of ceramic honeycomb structures located within an interior thereof.
Figure 5:
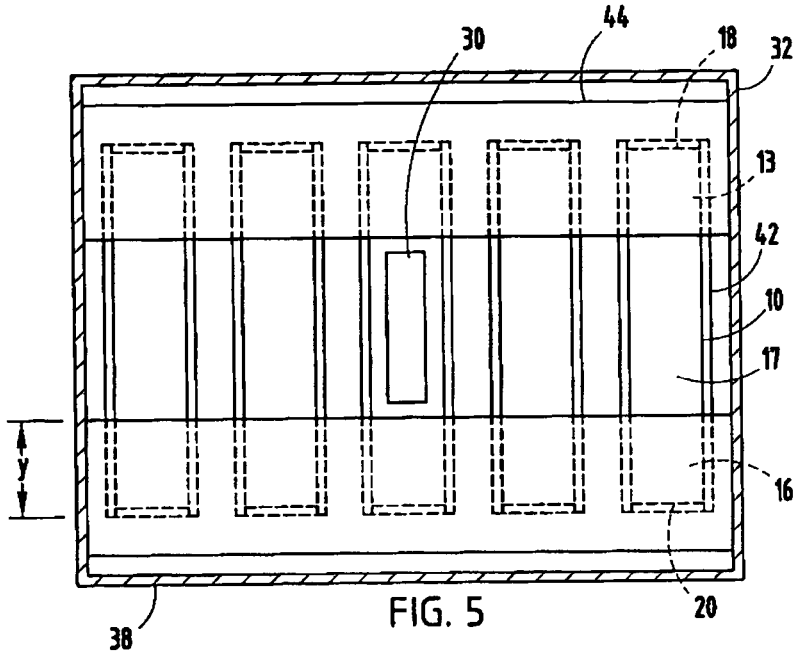
FIG. 5 is a cross-sectional top plan view of the microwave dryer of FIG. 4, with a plurality of ceramic structures located within the interior thereof.

Several methods and procedures are known in the art for forming green ceramic honeycomb structures featuring a plurality of hollow passages or channels extending therethrough. The present inventive process is directed to drying such structures regardless of the specific method used to form the honeycomb shape. The present inventive method for drying ceramic honeycomb structures 10 includes providing microwave radiation from a microwave generating source 30 (FIGS. 4-6) located within a microwave housing 32, exposing the ceramic honeycomb structure 10 to the microwave radiation, and shielding at least one of the ends 13, 16 from directly receiving the microwave radiation, such that the radiation absorbed by the middle portion 17 of the ceramic structure 10 is equal to or greater than the radiation absorbed by the at least one end 13, 16, as described herein. It is noted that the present inventive process may be used to process either plugged or non-plugged ceramic structures.

In the illustrated example, the microwave housing 32 includes a bottom wall 34, a top wall 36, and a pair of side walls 38. The microwave generating source 30 extends downwardly from the top wall 36 and is centrally located within the microwave housing 32. In the illustrated example, a plurality of ceramic structures 10 are positioned within an interior 40 of the microwave housing 32, each supported by an associated support tray 42. It is noted that the present inventive method can be accomplished either via batch style or continuous-type flow processing, and that the housing 32 may be configured to house a single structure 10, or multiple structures. Further, the structure(s) may be horizontally or vertically oriented as the drying process is completed. A pair of planar shield members 44 are positioned within the interior 40 of the microwave housing 32 and vertically above the structure 10 between the microwave generating source 30 and the ends 13, 16 of the structure 10, thereby shielding the ends 13, 16 of the ceramic structure 10 from directly receiving the microwave radiation such that the radiation absorbed by a middle portion 17 of the ceramic structure 10 is equal to or greater than the radiation absorbed at the ends 13, 16. Preferably, the amount of radiation absorbed by the middle portion is within the range of from 0% to 60% greater than the radiation absorbed by the ends 13, 16 of the structure 10, and more preferably within the range of from 10% to 40%.

Figure 6:
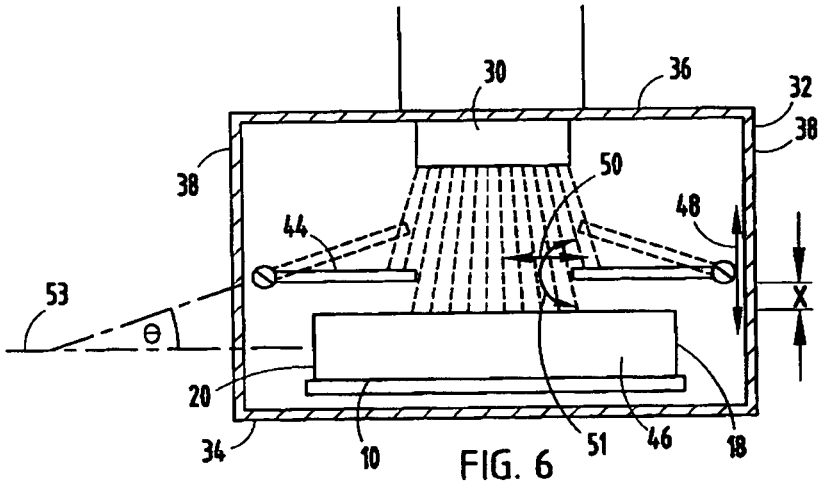
FIG. 6 is a cross-sectional end elevational view of the microwave dryer of FIG. 4, with a plurality of ceramic structures located within the interior thereof.

As best illustrated in FIG. 6, the shield members 44 are adjustable in several directions with respect to the ceramic structure 10 being processed, including a vertical direction 48 and a horizontal direction 50. Adjustment in the vertical direction 48 allows an operator to adjust the vertical distance of separation X between the uppermost portion of the ceramic structure 10 and the shield member 44. Preferably, the distance X is less than or equal to 1.5 times the wavelength of the microwave radiation, more preferably within the range of 1.5 to 1.0 times the wavelength of the microwave radiation, and most preferably is about 0.5 times the wavelength of the microwave radiation. Adjustment in the horizontal direction 50 allows the operator to adjust the amount of overlap Y each shield member 44 has with the associated ceramic structure 10. Preferably, the amount of overlap Y is within the range of from 0% to 30% of the overall length of the structure 10, and more preferably is within the range of from 0% to 10% of the overall length of the structure 10. Further, the relative angle θ between each shield member 44 and a longitudinal axis 53 of the ceramic structure 10 is also adjustable in a direction 51. Preferably, the angle θ is within the range of from 0° to 5°, and more preferably is about 0°. The adjustability of the shield members 44 allow fine tuning of the positions of the shield members 44 with respect to the ceramic structure 10 to optimize the drying thereof.

Figure 7:
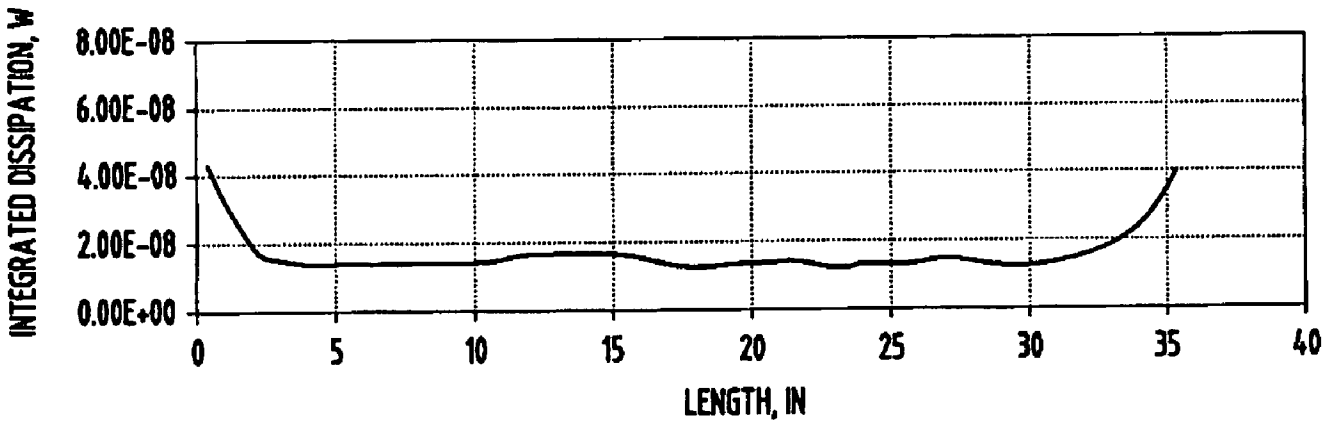
FIG. 7 is a graph of integrated dissipation vs. length for a ceramic structure dried via conventional means.
Figure 8:
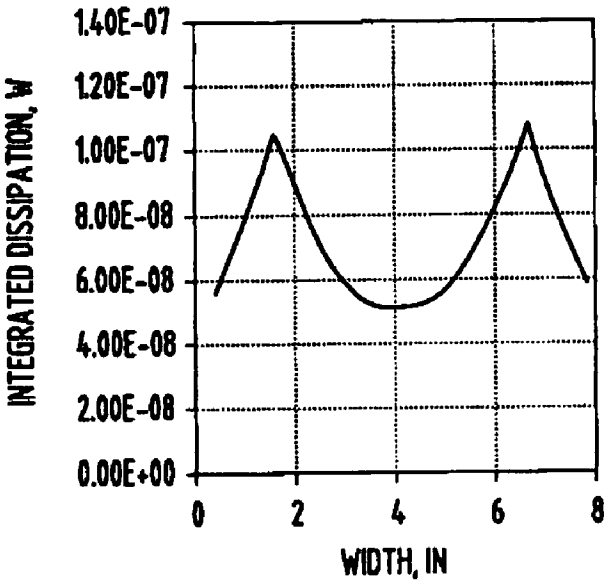
FIG. 8 is a graph of integrated dissipation vs. width for a ceramic structure dried via conventional means.

As noted above, shielding the ends 13, 16 of the ceramic structure 10 results in a more even power distribution within the ceramic structure 10, and as a result, a more uniform drying thereof. As best illustrated in FIG. 7, the integrated dissipation of the power absorbed by a structure subjected to microwave radiation within a conventional microwave drying, i.e., a drying that does not provide shielding, results in a power absorption that is significantly greater at the ends of the structure than an the middle portion thereof. Similarly, FIG. 8 illustrates that the power absorbed near the side wall 15 of the structure is also significantly greater than that absorbed near the center thereof.

Figure 9:
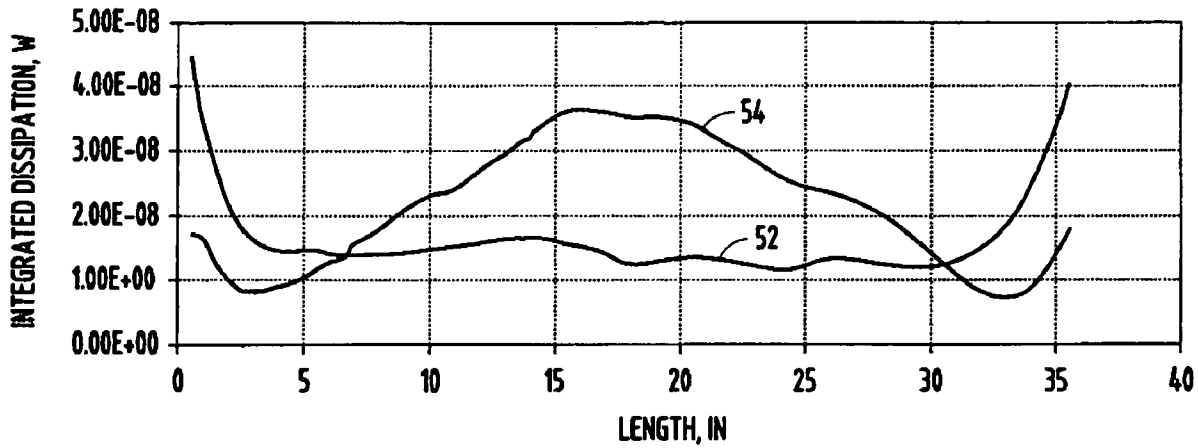
FIG. 9 is a graph of integrated dissipation vs. length for a ceramic structure dried via conventional means, and a ceramic structure dried via the present inventive process.
Figure 10:
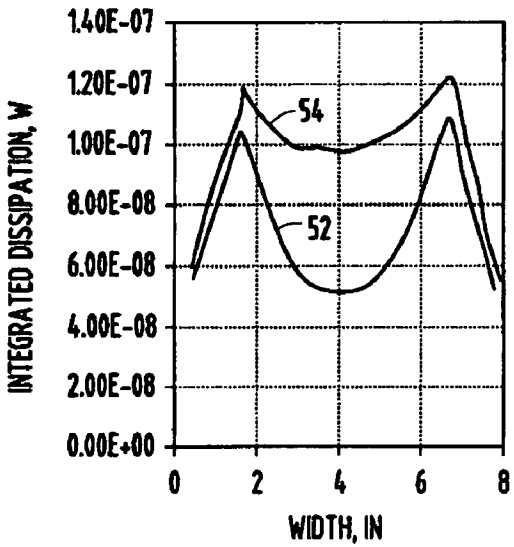
FIG. 10 is a graph of integrated dissipation vs. width for a ceramic structure dried via conventional means, and a ceramic structure dried via the present inventive process; via conventional means.
Figure 11:
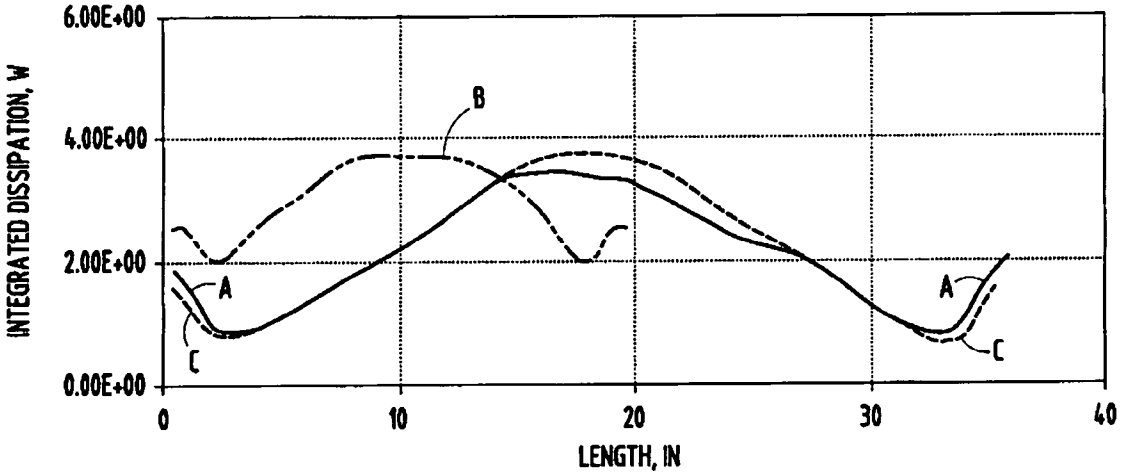
FIG. 11 is a graph of integrated dissipation vs. length for three modeled sample of ceramic structures dried via the present inventive process.
Figure 12:
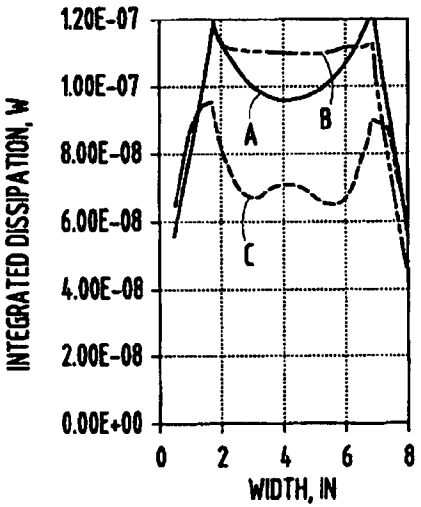
FIG. 12 is a graph of integrated dissipation vs. width for three modeled sample of ceramic structures dried via the present inventive process.

Modeled examples were completed on given ceramic structures both with and without shielding. FIGS. 9 and 10 illustrate integrated dissipation vs. length of the structure, and integrated dissipation vs. width of the structure, respectively, for an unshielded sample 52 and a shielded sample 54. Further, modeled examples were completed on three variations of system configurations utilized for processing a given ceramic structure. FIGS. 11 and 12 illustrate integrated dissipation vs. length of the structure, and integrated dissipation vs. width of the structure, respectively, of the three examples A-C. Example A included the modeling of a 36 inch in length structure with the distance X of the shield members 44 above the structure 10 being 10 inches, the overlap Y of the shield members 44 with the structure 10 being 10 inches, the angle θ between the shield members 44 and the structure 10 being 0°, and the number of structures 10 within the interior 40 of the housing 32 being 5. Example B included the modeling of a 20 inch in length structure with a distance X of 10 inches, an overlap distance Y of 18 inches, an angle θ of 0°, and 5 structures 10 simultaneously located within the interior 40 of the housing 32. Example C included the modeling of a 36 inch in length structure 10 with a distance X of 20 inches, an overlap distance Y of 10 inches, an angle θ of 0°, and 5 structures 10 simultaneously located within the interior 40 of the housing 32. It is clear from the integrated power dissipation along the length and width of the structures that the shielded process reduces the edge heating effect. Moreover, the integrated dissipation along the major axis (FIG. 10) shows a more uniform heating as compared to the end heating occurring without shielding.

Figure 13:
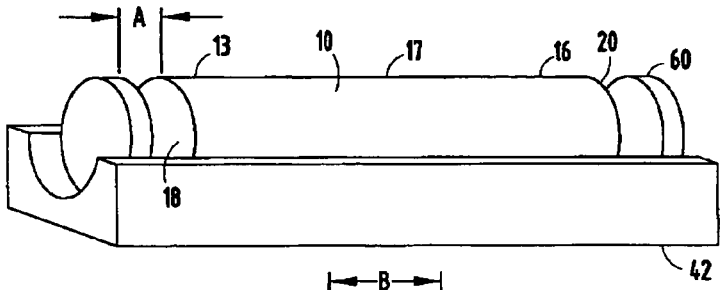
FIG. 13 is a side perspective view of a first alternative embodiment of the present inventive method, including a pair of shield members shielding end faces of the ceramic structure.

Alternative methods for shielding the ends 13, 16 and end faces 18, 20 of the ceramic structure 10 are also contemplated. It is noted that these alternative methods may be practice simultaneously with the other methods described herein. A first alternative embodiment includes the use of shield members 60 (FIG. 13) spaced from the end faces 18, 20 of the structure 10. In the illustrated example, the shield members 60 are placed within the tray 42 that supports and carries the structure 10 through the housing 32. Preferably, the shield members 60 are spaced a distance A from the associated end face 18, 20 of less than or equal to one quarter of the wavelength of the microwave radiation.

Figure 14:
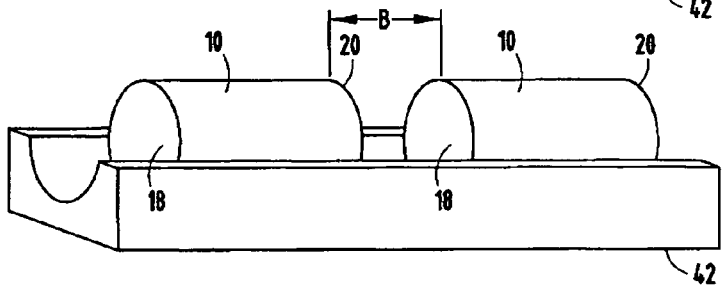
FIG. 14 is a side perspective view of a second alternative embodiment of the present inventive method, including a pair of ceramic structures positioned end-to-end.

A second alternative embodiment includes spacing multiple simultaneously processed ceramic structures 10 (FIG. 14) a distance B from one another. In the illustrated example, two structures 10 are placed within the same tray 42 such that the distance A between the corresponding end faces 18, 20 reduces or eliminates access thereto by the drying microwave radiation. Preferably, the distance B is less than or equal to about one quarter of a wavelength of the microwave radiation.

Figure 15:
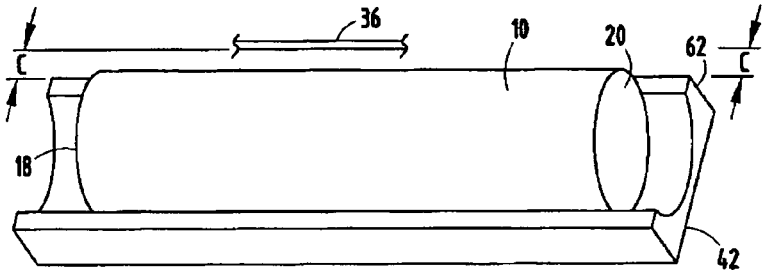
FIG. 15 is a top perspective view of a third alternative embodiment of the present inventive method, wherein the ceramic structure is spaced from the sidewalls of a microwave applicator on a support tray.
Figure 16:
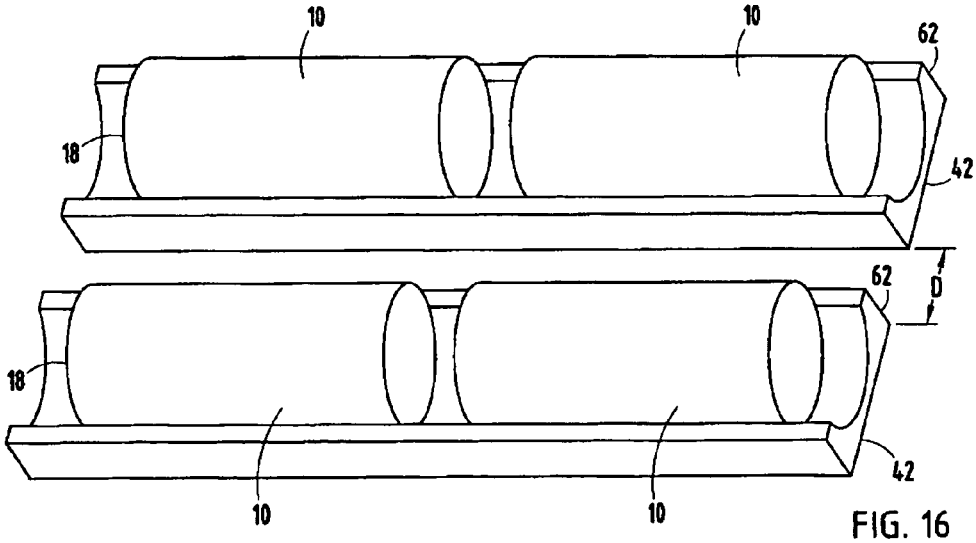
FIG. 16 is a top perspective view of a fourth alternative embodiment of the present inventive method, including multiple spaced trays.

Other alternative embodiments include placing the trays 42 (FIG. 15) relative to the sidewalls of a microwave applicator housing 32 (FIG. 5) such that the distance between the ends 18, 20 of honeycomb structures 10 and the associated sidewalls 38 (FIG. 5) is preferably less than about one half the wavelength of the microwave radiation. It is also useful to space multiple trays 42 (FIG. 16) within the interior 40 of a microwave applicator housing 32 such that the distance D between the trays 42 will provide a spacing of about one half of the wavelength of the microwave radiation between the honeycomb structures 10.

The present method is highly accurate and repeatable, may be completed in a relatively short cycle time, is relatively easy to perform, and results in a filter with relatively greater structural integrity with reduced deformation and degradation. The method further reduces the relative cracking and stress fractures within the desired structure produced during the drying process, reduces manufacturing costs associated with cycle times, is efficient to use, and is particularly well-adapted for the proposed use.

It will be understood from the foregoing that the specific devices and processes illustrated in the attached drawings and described in the foregoing specification are exemplary only, and that the specific dimensions and other physical characteristics relating to those embodiments are intended to be illustrative rather than limiting.

We claim:

1. A method for drying a ceramic structure comprising:

providing microwave radiation from a microwave generating source;

providing a ceramic honeycomb structure having a middle portion and two ends, the structure comprising walls defining channels extending between the two ends in the direction of a longitudinal axis, the structure being disposed such that the longitudinal axis is transverse to the microwave radiation being emitted from the microwave generating source;

exposing the ceramic honeycomb structure to the microwave radiation; and shielding at least one of the ends of the ceramic honeycomb structure from directly receiving the microwave radiation and such that the radiation absorbed by the middle portion is within the range of from about 10% to about 40% greater than the radiation absorbed by the at least one end.

2. The method of claim 1, where the shielding step includes providing at least one shield member positioned between a microwave generating source and the ceramic honeycomb structure, and that overlaps a portion of the ceramic honeycomb structure, thereby shielding the portion of the ceramic honeycomb structure from directly receiving the microwave radiation.

3. The method of claim 2, wherein the shield step includes positioning the at least one shield member vertically above the honeycomb structure.

4. The method of claim 2, wherein the step of providing the at least one shield member includes positioning the at least one shield member so as to overlap a first end of the ceramic honeycomb structure.

5. The method of claim 2, wherein the shielding step includes positioning the at least one shield member so as to overlap a range of from about 0% to about 30% of the overall length of the ceramic honeycomb structure.

6. The method of claim 5, wherein the shielding step includes positioning the at least one shield member so as to overlap a range of from about 0% to about 10% of the overall length of the ceramic honeycomb structure.

7. The method of claim 2, wherein the shielding step includes positioning the at least one shield member at a distance from the ceramic honeycomb structure of less than or equal to about 1.5 times a wavelength of the microwave radiation.

8. The method of claim 7, wherein the shielding step includes positioning the at least one shield member at a distance from the ceramic honeycomb structure within the range of from about 1.5 times the wavelength of the microwave radiation to about 1.0 times the wavelength of the microwave radiation.

9. The method of claim 8, wherein the shielding step includes positioning the at least one shield member at a distance from the ceramic honeycomb structure of about one half the wavelength of the microwave radiation.

10. The method of claim 2, wherein the at least one shield member defines a plane, and wherein the step of providing the at least one shield member includes positioning the at least one shield member so as to form an angle with a longitudinal axis of the ceramic honeycomb structure of within the range of from about 0° to about 5°.

11. The method of claim 2, wherein the at least one shield member and the at least one end of the honeycomb structure each define a plane, and wherein the step of providing the at least one shield member includes positioning the at least one shield member such that the planes of the at least one shield member and the at least one end of the honeycomb structure are substantially parallel to one another.

12. The method of claim 2, wherein the shielding step includes providing a first shield member positioned to shield a first end of the ceramic honeycomb structure, and a second shield member positioned to shield a second end of the ceramic honeycomb structure.

13. The method of claim 1, wherein the step of providing the ceramic honeycomb structure includes providing a second ceramic honeycomb structure having at least one end, and wherein the shielding step includes spacing the at least one end of the first honeycomb structure from the at least one end of the second honeycomb structure at a distance of less than or equal to about one quarter of a wavelength of the microwave radiation, thereby shielding the at least one end of the first ceramic honeycomb structure and the at least one end of the second honeycomb structure.

14. The method of claim 1, wherein the step of providing the ceramic honeycomb structure includes providing a second ceramic honeycomb structure; and further including:

providing a first tray having at least one side edge, the first tray supporting the first honeycomb structure and located within a housing within which the microwave generating source is located;

providing a second tray having at least one side edge, the second tray supporting the second honeycomb structure and located within the housing; and wherein the shielding step includes positioning the at least one side edge of first tray from the at least one side edge of the second tray at a distance of less than or equal to about one half of a wavelength of the microwave radiation.

15. The method of claim 1, wherein the shielding step includes providing a first shield spaced from the at least one end of the honeycomb structure by a distance of less than about three quarters of a wavelength of the microwave radiation.

16. The method of claim 15, wherein the step of providing the ceramic honeycomb structure includes providing the ceramic honeycomb structure with a first end and second end, and wherein the shielding step includes providing a second shield spaced from the second end of the honeycomb structure by a distance of less than about three quarters of a wavelength of the microwave radiation.

17. The method of claim 1, wherein the step of providing the honeycomb structure includes;

providing the honeycomb structure with an end face, and further including:

providing a housing having at least one side wall, wherein the at least one side wall of the housing is spaced from the end face of the honeycomb structure by a distance of less than about one half of a wavelength of the microwave radiation.

18. The method of claim 1, wherein the step of providing the microwave radiation from the microwave generating source includes positioning the microwave generating source in a position relative to the honeycomb structure such that a majority of the microwave radiation is absorbed by the middle portion of the honeycomb structure.

19. The method of claim 1, wherein the exposing step includes exposing the ceramic honeycomb structure to the microwave radiation when the honeycomb structure is in a substantial horizontal orientation.

20. The method of claim 1, wherein microwave radiation is directed vertically downward.

* * * * *

UNITED STATES PATENT AND TRADEMARK OFFICE

CERTIFICATE OF CORRECTION

PATENT NO. : 7,596,885 B2
APPLICATION NO. : 11/495203
DATED : October 6, 2009
INVENTOR(S) : Adrian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 566 days.

Signed and Sealed this

Twenty-eighth Day of September, 2010

David J. Kappos

David J. Kappos
*Director of the United States Patent and Trademark Office*